US008056605B2

(12) United States Patent
Hirata et al.

(10) Patent No.: US 8,056,605 B2
(45) **Date of Patent: *Nov. 15, 2011**

(54) FLASKLESS MOLDING METHOD

(75) Inventors: Minoru Hirata, Toyokawa (JP); Takayuki Komiyama, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 301 days.

This patent is subject to a terminal disclaimer.

(21) Appl. No.: 11/913,624

(22) PCT Filed: May 10, 2006

(86) PCT No.: PCT/JP2006/309400

§ 371 (c)(1),
(2), (4) Date: Nov. 5, 2007

(87) PCT Pub. No.: WO2006/121076

PCT Pub. Date: Nov. 16, 2006

(65) Prior Publication Data

US 2009/0078389 A1 Mar. 26, 2009

(30) Foreign Application Priority Data

May 10, 2005 (JP) ..... 2005-137127

(51) Int. Cl.
*B22C 9/00* (2006.01)
*B22C 15/02* (2006.01)
*B22C 15/24* (2006.01)

(52) U.S. Cl. ..... 164/20; 164/201

(58) Field of Classification Search ..... 164/19–22, 164/200–202

See application file for complete search history.

(56) References Cited

U.S. PATENT DOCUMENTS

| | | | | |
|---|---|---|---|---|
| RE28,735 | E * | 3/1976 | Lund et al. | 164/195 |
| 4,463,794 | A * | 8/1984 | Shioda | 164/182 |
| 6,499,531 | B1 * | 12/2002 | Knudsen | 164/211 |
| 7,654,302 | B2 * | 2/2010 | Hirata et al. | 164/20 |
| 7,654,303 | B2 * | 2/2010 | Hirata et al. | 164/20 |

FOREIGN PATENT DOCUMENTS

| | | |
|---|---|---|
| EP | 0 098 405 A | 1/1984 |
| JP | 62-16736 | 2/1981 |
| JP | 2003-103345 | 4/2003 |
| JP | 2005-7439 | 1/2005 |
| JP | 2005-7439 A | 1/2005 |

* cited by examiner

*Primary Examiner* — Kuang Lin
(74) *Attorney, Agent, or Firm* — Finnegan, Henderson, Farabow, Garrett & Dunner, L.L.P.

(57) ABSTRACT

A flaskless molding method, wherein a match plate (5) is held between an upper flask (2) and a lower flask (3) and squeeze plates (6) and (7) are inserted into the openings of the upper flask (2) and the lower flask (3) to form an upper manufacturing space and a lower manufacturing space with initial volumes. A foundry sand is filled in the upper and lower manufacturing spaces with the initial volumes through the supply ports of the flask (2) and (3) (first filling). Next, the squeeze plates (6) and (7) are retreated to expand the upper and lower manufacturing spaces more than the initial volumes. The foundry sand is filled again in the expanded upper and lower manufacturing spaces through the supply ports (second filling). After the second filling is completed, the squeeze plates (6) and (7) are advanced to compress the foundry sand in the upper and lower manufacturing spaces so as to manufacture the upper and the lower flasks stacked on each other.

12 Claims, 4 Drawing Sheets

FLASKLESS MOLDING METHOD

FIELD OF THE INVENTION

This invention relates to a molding method, and, more particularly, to a flaskless molding method in which formed molds are removed from flasks after the molds are formed.

BACKGROUND OF THE INVENTION

Japanese Early-Patent Publication No. 62 [this corresponds to the year 1987]-16736 discloses a flaskless molding machine for molding stacked flaskless molds by using two pairs of a cope flask and a drag flask in which one cope flask and one drag flask form one pair. In this machine, mounted on the upper side of a machinery mount is a squeeze station that horizontally squeezes molding sand horizontally as viewed from the floor level. Further, mounted on the lower side or near the floor level is a stripping station for matching the molds and removing them vertically from the flasks as viewed from the floor level. Two pairs of the cope flask and the drag flask are alternately and intermittently and reciprocatingly moved between the squeeze station and the stripping station. With this arrangement, because an interchangeable match plate to be sandwiched between the cope and drag flasks can be exchanged near the floor level, the necessary labor is reduced.

The foregoing conventional machine, however, may encounter a problem. It is that insufficient molding sand might be charged into the flasks, and thus the resulting molds might lack the desired hardness. Accordingly, there is a need for a flaskless molding method that can steadily and readily produce molds having the desired hardness.

SUMMARY OF THE INVENTION

The present invention provides methods for molding stacked upper and lower molds with a flaskless molding machine that includes a cope flask and a drag flask. Each flask defines an opening and has at least one sand-filling port for injecting molding sand into the opening, a match plate having upper and lower patterns on top and bottom faces corresponding to the cope and drag flasks, and upper and lower squeezing members, each squeezing member being insertable in and retractable from the corresponding opening of the corresponding flask for squeezing the molding sand to be molded.

One of the methods comprises the steps of defining upper and lower molding spaces by inserting the upper and lower squeezing members into the respective openings of the respective flasks opposed to the respective patterns of the match plate such that the upper molding space is defined by the cope flask, the top face of the match plate, and the upper squeezing member, and the lower molding space is defined by the drag flask, the bottom face of the match plate, and the lower squeezing member, wherein each molding space has an initial volume; a first injection of the molding sand into each molding space that has the initial volume, from the sand-filling ports; increasing the volume in each molding space above the initial volume by retracting the upper and lower squeezing members by a predetermined length; a second injection of the molding sand into each molding space that has the increased volume, from the sand-filling ports; advancing the upper and lower squeezing members, followed by the second injecting step, to squeeze the molding sand within the upper and lower molding spaces to mold stacked upper and lower molds; and removing the resulting upper and lower molds from the cope and drag flasks.

In one embodiment of the present invention, the cope and drag flasks are in their vertical positions during the steps of the first and second injections of the molding sand, whereas they are in their horizontal positions during the step of removing the resulting molds. In this case, the step of defining the molding spaces is carried out while the cope and drag flasks are returning from their horizontal positions, during which the stripping of the molds has been completed, to their vertical positions.

Another method of the present invention comprises clamping and holding the match plate between the cope flask and the drag flask, wherein the cope and drag flasks are in their horizontal positions; defining upper and lower molding spaces by inserting the upper and lower squeezing members into the respective openings of the respective flasks opposed to the respective patterns of the match plate such that the upper molding space is defined by the cope flask, the top face of the match plate, and the upper squeezing member, and the lower molding space is defined by the drag flask, the bottom face of the match plate, and the lower squeezing member, wherein each molding space has an initial volume; turning the cope and drag flasks and the match plate to their vertical positions in unison; a first injection of the molding sand into each molding space that has the initial volume, from the sand-filling ports; increasing the volume in each molding space above the initial volume by retracting the upper and lower squeezing members by a predetermined length; a second injection of the molding sand into each molding space that has the increased volume, from the sand-filling ports; advancing the upper and lower squeezing members to squeeze the molding sand within the upper and lower molding spaces, while returning the cope and drag flasks and the match plate to their horizontal positions in unison; removing the match plate from the cope and drag flasks, wherein each flask contains a mold; stacking the cope flask and the drag flask; and removing the molds from the stacked cope and drag flasks.

The method may, if necessary, further comprise the step of setting a core in each mold before the step of stacking the cope flask and the drag flask is carried out.

In one embodiment of the present invention, the step of defining the molding spaces is carried out while the cope and drag flasks, and the match plate, are in their horizontal positions. During the step of turning the cope and drag flasks, and the match plate, to their vertical positions in unison, the sand-filling ports for injecting the molding move upward.

In each method of the present invention, the step of the second injection may begin after each molding space has reached the desired volume and thus the step of increasing the volume in each molding space is completed. Alternatively, the step of the second injection may be applied while the upper and lower squeezing members are still retracted during the step of increasing the volume in each molding space such that the step of the second injection can begin before the step of increasing the volume in each molding space has been completed by reaching the desired volume.

In each method of the present invention, each of the upper and lower squeeze members may be a squeezing plate or a squeezing foot.

THE PREFERRED EMBODIMENTS OF THE INVENTION

Figure 1:
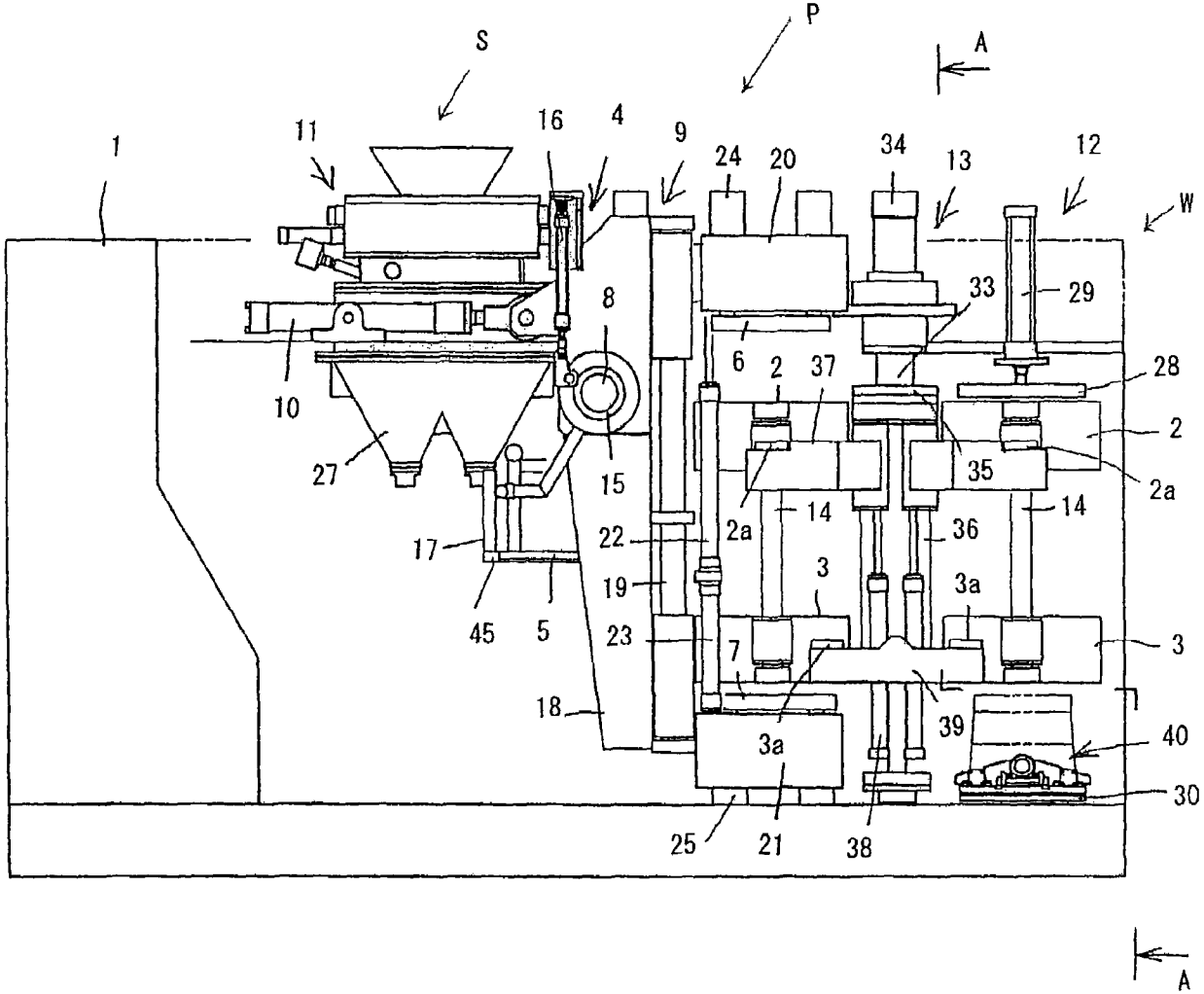
FIG. 1 is a front view, partly in cross section, of an example of the flaskless molding machine that is applicable to the method of the present invention.
Figure 2:
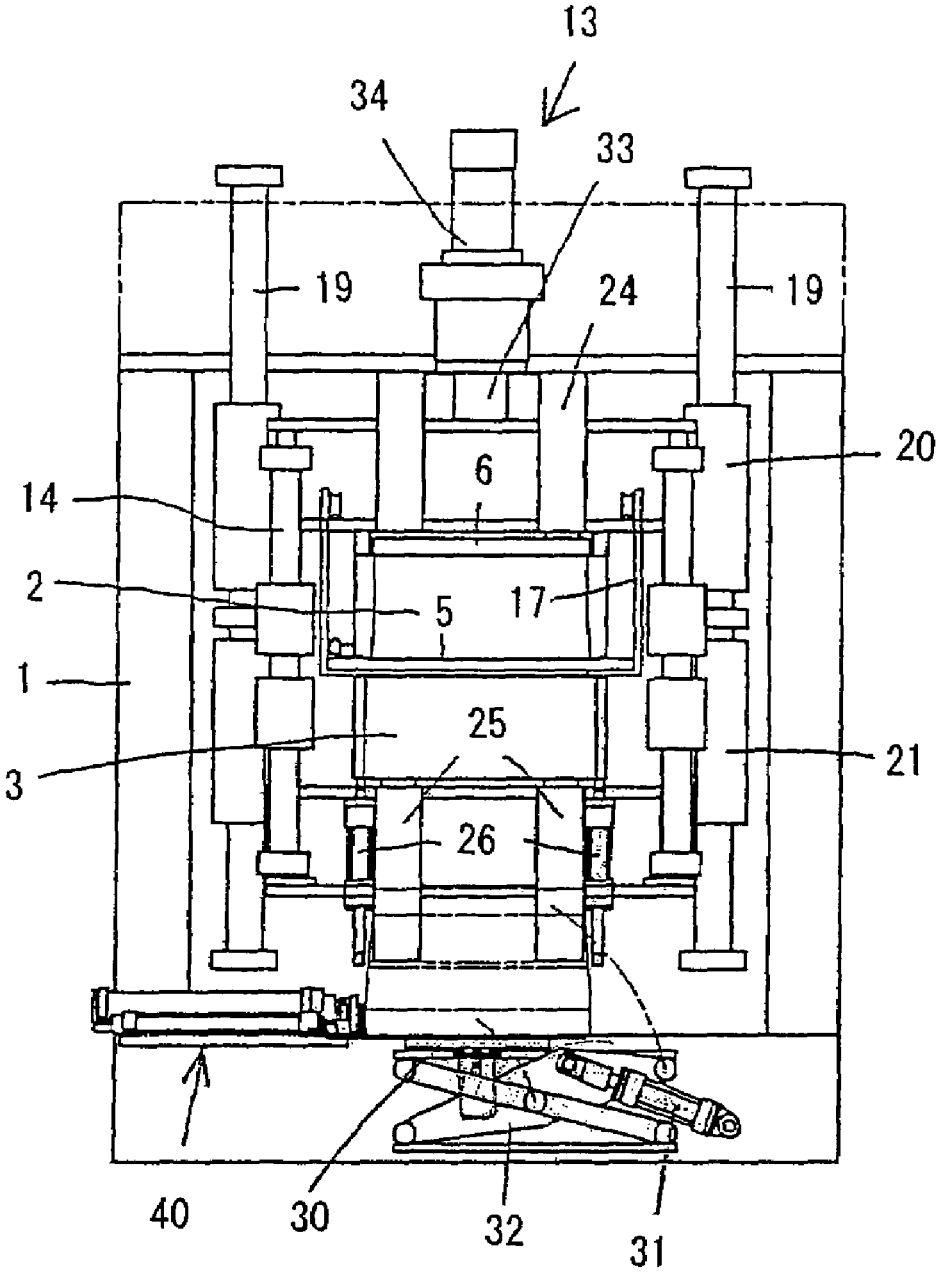
FIG. 2 shows a view taken along arrows A-A of FIG. 1, where a match plate is clamped and held between a cope flask and a drag flask.
Figure 3:
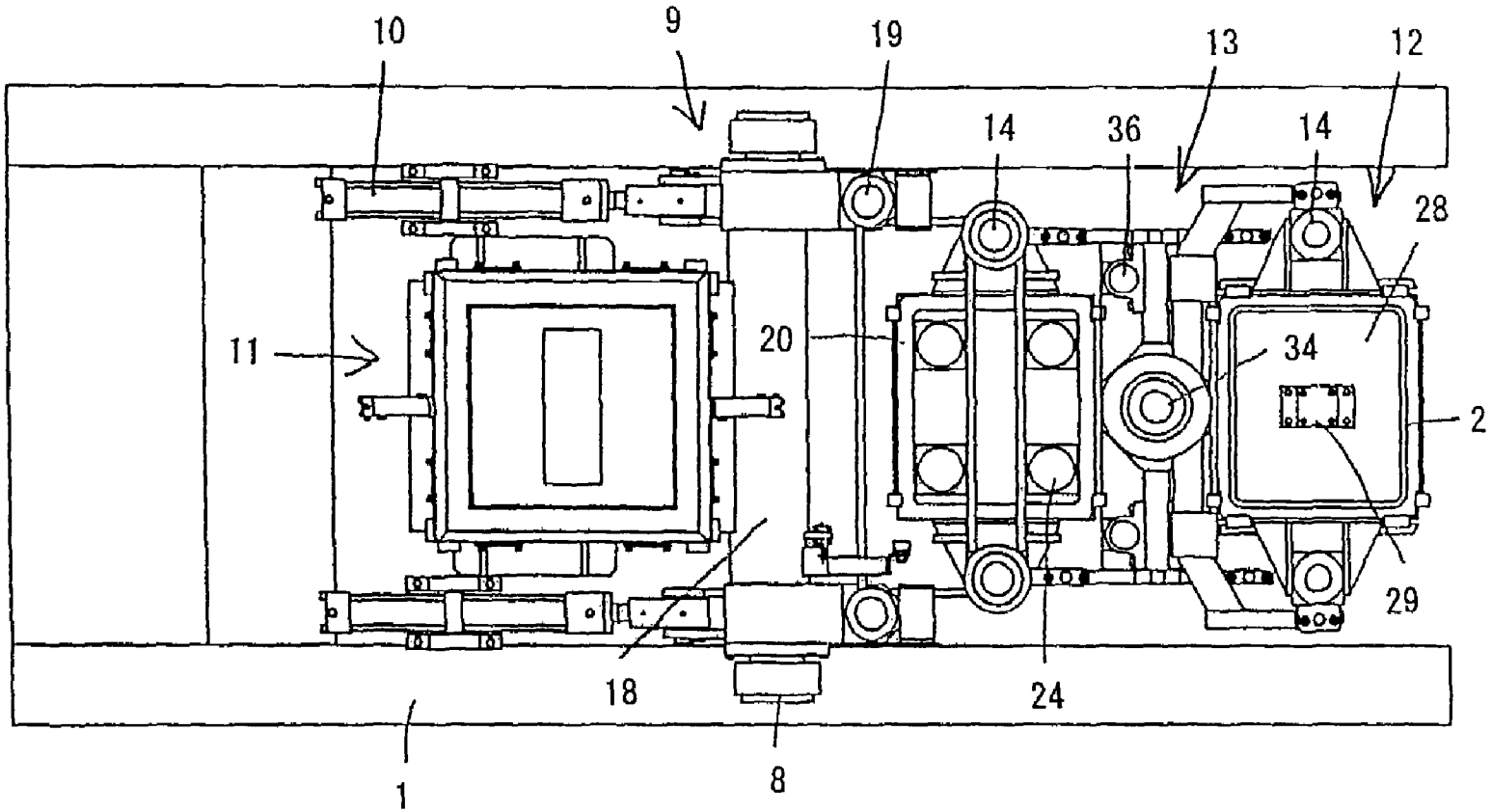
FIG. 3 is a top view of the molding machine of FIG. 1.

FIGS. 1 to 4 show the flaskless molding machine to implement the molding method of the present invention. The molding machine includes a rectangular machinery mount whose inner chamber includes a station P for defining molding spaces, a sand-supplying station S, and a core setting/mold stripping station W.

The station P, which defines the molding spaces, has two pairs of a cope flask 2 and a drag flask 3. Each flask defines an opening and has a sand-filling port on its sidewall for supplying molding sand. Although in this embodiment one flask has just one sand-filling port, one or more sand-filling ports may be provided with the one flask. The station P includes a carrying means such as a shuttle 4 for carrying in and carrying out a match plate 5. Both faces of it are formed with patterns, between one of the two pairs of the cope flask 2 and the drag flask 3, and a squeezing means or mechanism 9. The squeezing mechanism 9 includes an upper squeeze plate 6 and a lower squeeze plate 7. They are insertable in and removable from the corresponding openings of the flasks that oppose the match plate 5 when it is clamped and held between one pair of the core flask and the drag flask. The squeeze mechanism 9 is pivotally supported on a supporting shaft 8 that is mounted on the machinery mount such that the squeeze mechanism 9 can be reversiblely rotated about the supporting shaft 8 in the vertical plane. The range of the rotating or pivoting motion of the squeezing mechanism 9 is between the vertical position and horizontal position. In the vertical position, a pair of the cope flask 2 and the drag flask 3 that are clamped and that hold the match plate 5 therebetween are in their vertical positions. Meanwhile, they are in their horizontal positions at the horizontal position of the rotating motion of the squeezing mechanism 9. The station P, which defines the molding spaces, also has a means such as a transverse cylinder 10 for reversibly rotating the squeeze mechanism 9.

The sand-supplying station S includes a sand-supplying means or device 11 for filling molding sand into a pair of the cope flask 2 and the drag flask 3 that have been in the vertical position, by extending the cylinder 10 through the sand-filling ports.

The core setting/mold stripping station W includes mold-stripping means or equipment 12 for stripping the resulting upper half-mold and the lower half-mold from the paired cope and flask 2 and drag flask 3, which are positioned in their horizontal positions and which are stacked such that they contain the upper half-mold and the lower half-mold. The core setting/mold stripping station W also includes a rotating means or mechanism 13 for alternatively and intermittently rotating two pairs of the stacked cope flasks 2 and drag flasks 3 in the horizontal state, in which one pair of the flasks and another pair of flasks are deposed in a parallel relation on a horizontal level, one at a time, between the squeezing mechanism 9 and the mold-stripping device 12. The rotating mechanism 13 also can be engaged with each cope flask 2 to move it up and down.

In each pair of the cope flask 2 and drag flask 3 of the two pairs, as shown in FIG. 1 a pair of connecting rods 14 is vertically and slidably suspended from the front and rear sides of the cope flask 2. The lower ends of the connecting rods 14 can be engaged with the drag flask 3.

Engaging members 2*a* are attached to the center positions of the opposed sides of the cope flask 2, while engaging members 3*a* are attached to the ends of the opposed sides of the drag flask 3 when it is in the squeezing mechanism 9 such that the one pair of the cope flask 2 and the drag flask 3 can be supported by the rotating mechanism 13. For example, each engaging member 2*a* or 3*a* may have a convex shape with a bore for receiving a pin (not shown) so as to be connected to a mating upper engaging member 37 or the mating lower engaging member 39 (discussed below) of the rotating mechanism 13. Because the profile of each engaging member 2*a* or 3*a* may take any form that is suitable for being connected or detachably attached to the mating engaging member 37 or 39, it may take, e.g., a concave profile.

As shown in FIG. 1, the shuttle 4 for carrying the match plate includes a ring member 15 that is fitted on the supporting shaft 8 of the squeezing mechanism 9, and a cylinder 16, which is pivotally attached to the sand-supplying device 11. The end of a piston rod of the cylinder 16 is pivotally connected to a portion of the ring member 15. The shuttle 4 also includes a pair of cantilevered arms 17, the bases of the ends are attached to the ring member 15. The shuttle 4 also includes a suspended truck 45 that is laterally movable when the match plate 5 is placed on it. The truck 45 is lowered by a predetermined, relatively short, distance by means of the cope flask 2, while the paired and cantilevered arms 17 are pivoted up and down by a telescopic motion of the cylinder 16 such that the arms 17 are engaged with and disengaged from the truck 45. The truck 45 runs on rails (not shown) that are provided on the cope flask 2 and the drag flask 3, to carry in and carry out the match plate 5 between the horizontal cope flask 2 and drag flask 3 in the squeezing mechanism 9.

To move the arms 17, the cylinder 16 may be replaced with, e.g., a motor, etc.

Figure 4:
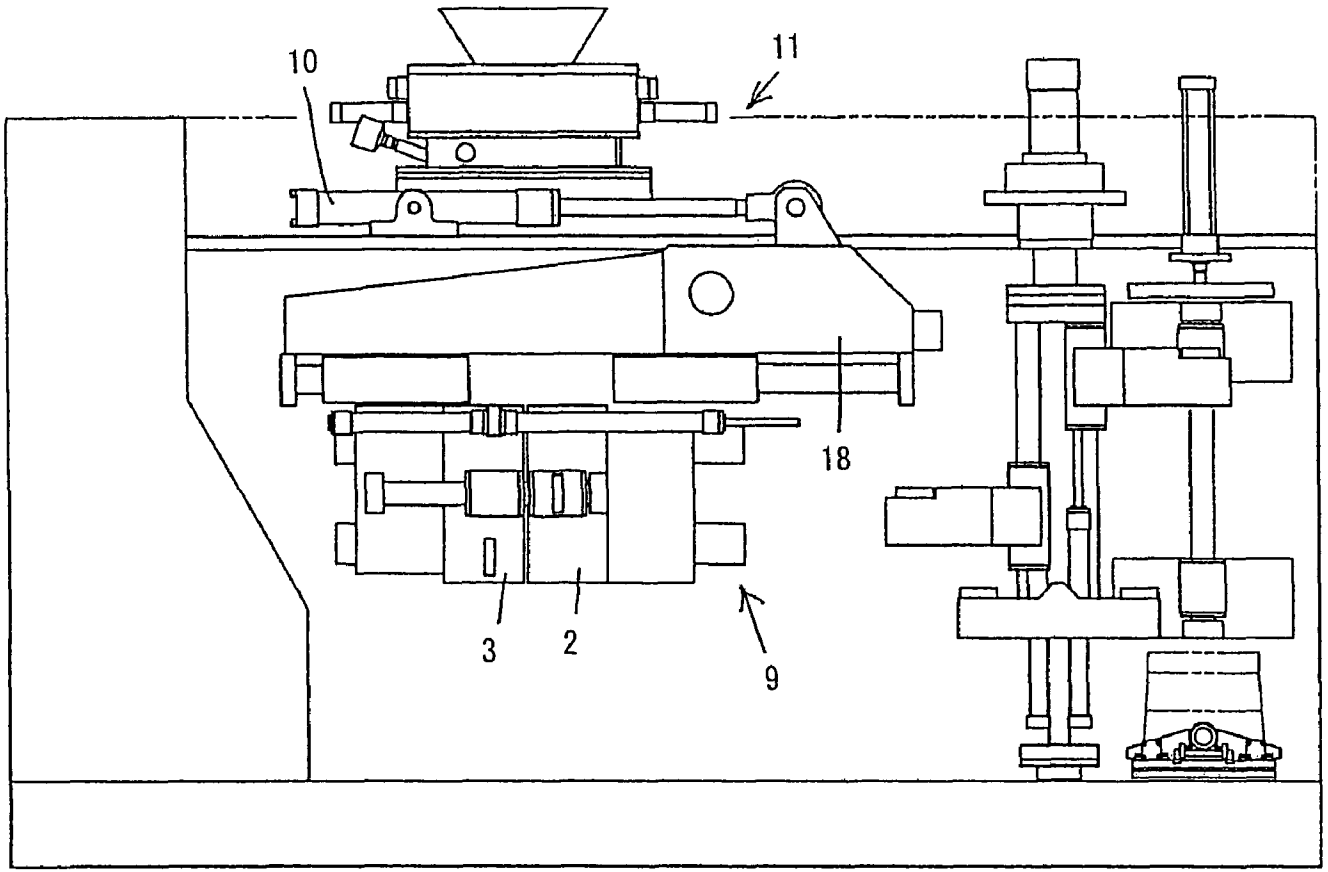
FIG. 4 is an illustrative sequence of the molding machine of FIG. 1 with a step of injecting molding sand into the cope and drag flasks.

In the squeezing mechanism 9, as shown in FIG. 4, a rotating frame 18 is rotatably fitted to the approximate center portion of the supporting shaft 8, which is mounted on the center of the upper surface of the machinery mount 1. The rotating frame 18 can thus be reversibly rotated in the vertical plane. The right side of the rotating frame 18 is provided with a pair of vertical, elongated guiding arms 19. The guiding arms 19 are positioned in the rear and front in relation to each other, to form a predetermined distance therebetween. A reverse-L-shaped upper vertically-moving frame 20 and an L-shaped lower vertically-moving frame 21 are vertically and slidably mounted on and across the upper portions and the lower portions, respectively, of two guiding rods 19, by means of holders, each of which is integrally provided with a corresponding frame 20 or 21. The upper vertically-moving frame 20 and the lower vertically-moving frame 21 can be moved close to and away from each other by a telescopic motion of an upwardly-facing cylinder 22 and a downwardly-facing cylinder 23, respectively. These cylinders 22, 23 are mounted on the rotating frame 18.

The upper vertically-moving frame 20 has a plurality of cylinders 24 for advancing and retracting the upper squeezing plate 6, while the lower vertically-moving frame 21 has a plurality of cylinders 25 for advancing and retracting the lower squeezing plate 7. The horizontal surface of each squeezing plate 6 or 7 has a cross section that suffices to press the corresponding cope or drag flask 2 or 3.

In this embodiment, the cylinders for driving the squeezing plates 6 and 7 cooperate to move in unison with the rotating frame 18. Alternatively, the cylinders may be fixed on the fixed portions. Further, one group of the cylinders of the squeezing plate 6 or 7 may cooperatively move in unison with the rotating frame, and the other group of cylinders, of the corresponding squeezing plate, may be fixed on the fixed portion.

In this embodiment, the sand-supplying device 11, which is mounted on the top of the machinery mount 1 (near the left side in the figure), includes two aeration tanks 27 so as to separately introduce the molding sand into the cope flask 2 and the drag flask 3, while the injected molding sand is floated or fluidized ("aeration-injecting process") by compressed air with a low pressure. Typically, however, just one aeration tank may be used to fill the molding sand into both the cope flask 2 and the drag flask 3.

The aeration-injecting sand for floating or fluidizing the molding sand using the compressed air with the low pressure is disclosed, in, e.g., U.S. Pat. No. 6,749,003 B2, assigned to the applicant of the present application. It was found that the desirable pressures of the low-pressure air are from 0.05 Mpa to 0.18 Mpa. However, a suitable injecting process that can be used for the present invention is not limited to the fluidizing and injecting process. For example, a blowing injecting process using compressed air with a higher pressure may be used in the present invention. Alternatively, the sand-supplying device 11 may be connected to a decompressor (not shown) to be used together with air at a low pressure, i.e., below atmospheric pressure, in either the aeration-injecting process or the blowing-injecting process.

The mold-stripping device 12 includes a stripping plate 28, which is insertable in and retractable from the overlapped horizontal cope flask 2 and drag flask 3. That stripping plate 28 is attached to the lower end of the piston rod of a downwardly-facing cylinder 29 that is mounted on the roof of the machinery mount 1. The stripping plate 28 can be moved vertically by a telescopic motion of the cylinder 29. Placed intermediately below the stripping plate 28 is a receiving table 30 for receiving an upper half-mold and a lower half-mold to be withdrawn from the cope flask 2 and the drag flask 3, respectively. Preferably, the receiving table 30 is moved vertically by a pantograph 32 that can be extended and retracted by telescopic motions of a cylinder 31. The pantograph 32 may be replaced with a common lift table that is moved by a suitable cylinder. However, using the pantograph 32 as a driver for elevationally moving the receiving device 30, as in this embodiment, requires no pit for receiving the driver on the floor level on which the molding machine is installed (see FIG. 2).

In the rotating mechanism 13, a vertically elongated, rotary shaft 33 is horizontally and rotatably mounted on the machinery mount 1. The upper end of the rotary shaft 33 is connected to the output of a motor 34, which is mounted on the top of the machinery mount 1. The rotary shaft 33 can be reversibly turned within a turning range of 180° by driving the motor 34. The motor 34 may be replaced with a suitable cylinder.

The turning range of 180° of the rotary shaft 33 is just an example of its possible turning ranges for transferring the resulting mold from the on-site position where the mold is formed to the mold-stripping equipment 12 by the rotating mechanism 13. Because this turning range is defined and based on the site where the mold-stripping equipment 12 is installed, it is not limited to the 180°. The equipment 12 may be installed in any site, based on the desirable turning range of the shaft.

The upper portion of the rotary shaft 33 has a supporting member 35 from which two pairs of guiding rods 36 are suspended. They are arranged in a back and front relationship to form a predetermined distance therebetween such that they are opposed to each other across the rotary shaft 33 that is centered therebetween. The upper engaging member 37 is vertically and slidably fitted on each pair of the guiding rods 36 to engage the engaging members 2*a*. The upper engaging member 37 is attached to the distal end of the piston rod of the cylinder 38 that is mounted on the rotary shaft 33. The upper engaging member 37 can thus be vertically moved by a telescopic motion of the cylinder 38. The lower ends of the two pairs of the guiding rods 36 are attached to a lower engaging member 39, which that can be engaged to the engaging members 3*a* of the two drag flasks 3.

One of the functions of a mold ejector 40 is to push out the upper and lower half-molds, which are drawn from the cope flask 2 and the drag flask 3, from the receiving table 30.

With the molding method of the present invention, first, the match plate 5 is carried in between the horizontal cope and drag flasks 2 and 3 by extending the cylinder 16 of the shuttle 4.

The cope flask 2 and the drag flask 3 are then moved closer to each other by means of the upper and lower vertically-moving frames 20 and 21 by retracting both the upwardly-facing cylinder 22 and the downwardly-facing cylinder 23 of the squeezing mechanism 9. The cope flask 2 and the drag flask 3 are then clamped, and hold the match plate 5 therebetween, while the clustered cylinders 24 and 25 are extended by a predetermined stroke length. This causes the upper squeeze plate 6 and the lower squeeze plate 7 to be inserted in the openings of the cope flask 2 and the drag flask 3 by a predetermined length, to define an upper molding space and a lower molding space. As used herein, the volume of each molding space in this state refers to the initial volume. The predetermined stroke length of the extending motion of the clustered cylinder 24 or 25 and thus the predetermined length of the insertion of the upper squeeze plate 6 or the lower squeeze plate 7 corresponds to the initial volume of the molding space to be defined. In addition, the clustered cylinders 24, 25 may be replaced with a combination of just one large-diameter cylinder and a guide pin.

When the upper and lower molding spaces, each of which has the initial volume, are defined, the cylinder 10 is extended to rotate the squeeze mechanism 9 clockwise about the supporting shaft 8 such that the paired cope and drag flasks 2 and 3, and the match plate 5, are positioned at their vertical positions while the sand-filling ports are raised.

The raised sand-filling ports abut the lower ends of the two aeration tanks 27 of the sand-supplying device 11 (see FIG. 4).

If the height of the cope flask 2 is the same as that of the drag flask 3, the paired molding spaces may be simultaneously defined. Alternatively, if the cope flask 2 and the drag flask 3 have different heights, two molding spaces may be separately defined at different times.

In the sand-injecting station S, the sand-supplying device 11 then injects the molding sand into the paired upper and lower molding spaces through the sand-filling ports (a first injection step), using any suitable injecting method, such as aeration injecting with compressed air that has a low pressure, namely, below atmospheric pressure.

The clustered cylinders 24 and 25 are retracted by the predetermined stroke length to retract the upper and lower squeeze plates 6 and 7 in immediate proximity to the corresponding openings of the paired cope flask 6 and drag flask 7. Therefore, the volume of each molding space is increased from its initial volume.

The sand-supplying device 11 then re-injects the molding sand into the increased upper and lower molding spaces through the sand-filling ports (a second injection step). The paired cope flask 2 and drag flask 3, and the match plate 5, are returned to their horizontal positions. During this movement, the clustered cylinders 24, 25 are extended such that the upper squeezing plate 6 and lower squeezing plate 7 move into the corresponding flasks to squeeze the molding sand within the two molding spaces.

Accordingly, the molding sand is squeezed, followed by the two steps of injecting the molding sand. During them the first injecting step is carried out when each molding space has the initial volume. The second injecting step is applied to the increased molding spaces. The two steps of injecting the molding sand result in the increased hardness of the mold. This remarkable effect may be seen at the portions of the molds near the openings of the paired cope flask 2 and drag flask 3 that contain the molds.

In the two steps of injecting the molding sand in this embodiment, the first injecting step is applied to the molding spaces, each of which has the initial volume. The second injecting step is applied after the increased volumes of the molding spaces, caused by retracting the upper and lower squeeze plates 6 and 7, have been completed.

About the beginning of the second injecting step, however, it is not necessary to wait until the increased volumes of the old spaces have been completed. For example, followed by the first injecting step, while the upper and lower squeeze plates 6 and 7 are being retracted (and thus the volumes of the molding spaces are being increased), the second injecting step may be begun. Accordingly, the blowing of the molding sand into the molding spaces may be continued without any interruption between the first injection step and the second injection step.

Following the two steps of injecting the molding sand, the upwardly-facing cylinder 22 and the downwardly-facing cylinder 23 are extended such that the upper vertically-moving frame 20 and the lower vertically-moving frame 21 are spaced apart from each other.

In the core setting/mold drawing station W, the cope flask 2, which contains the half-mold, which is produced by squeezing the molding sand, is lifted by means of the upper engaging member 37 to separate it from the match plate 5 by extending the cylinder 38 of the rotating mechanism 13. Meanwhile, the drag flask 3 is disposed on the lower engaging member 39 of the rotating member 13. The match plate 5 is then carried out from between the cope flask 2 and the drag flask 3 by means of the paired arms 17, by retracting the cylinder 16.

The motor 34 of the rotating mechanism 13 is driven to turn the rotary shaft 33 in a predetermined range such that the paired upper flask 2 and drag flask 3, each of which contains a mold, are transferred to the mold-stripping equipment 12. A core may then be disposed in each mold, if necessary. The cylinder 38 is then retracted to lower the cope flask 2 that contains the mold by means of the engaging member 37 such that the cope flask 2 and the drag flask 3 are stacked.

The cylinder 31 of the mold-stripping equipment 12 is then extended to rise on the receiving table 30 such that the cope flask 2 and drag flask 3 that contain the molds are disposed on the receiving table 30. The cylinder 29 of the mold-stripping equipment 12 is extended such that the stripping plate 28 contacts the half-mold within the cope flask 2. The cylinder 31 is then retracted to lower the stripping plate 28 and the receiving table 30 in a cooperative relationship to strip the half-molds from the paired cope flask 2 and drag flasks 3. The cylinder 31 is then retracted at the level at which the half-molds are to be ejected such that the ejector 40 is pushed off the paired upper and lower half-molds from the receiving table 40.

In the above-described processes, it is desirable that a core be put in each formed half-mold, if so needed. If so, a core is put in each preceding formed half-mold before the cope flask 2 and the drag flask 3, each containing a new formed half-mold, are rotated and thus transferred to the mold-stripping equipment 12. The paired cope flask 2 and drag flask 3 are then stacked on each other to push out the half-molds in them, as discussed above.

Although the present invention has been described with reference to the illustrative embodiments, they are not intended to limit the present invention. It will be apparent that various modifications can be made without departing from the spirit of the present invention, as set forth in the appended claims.

For example, although the squeezing means are shown as the upper and lower squeezing plates 6 and 7, they may be replaced with squeeze feet that are separately controllable by means of restrictive hydraulic cylinders, and are arranged in respective segments.

The invention claimed is:

1. A method for molding stacked upper and lower molds with a flaskless molding machine that includes:

two pairs of a cope flask and a drag flask, each flask defining an opening and having at least one sand-filling port on a sidewall thereof for injecting molding sand into the opening;

a match plate having upper and lower patterns on top and bottom faces corresponding to the cope and drag flasks of the two pairs of the flasks; and a mold space defining station, a sand-supplying station and a mold stripping station;

said method comprising the steps of:

clamping and holding the match plate between one pair of the cope and drag flasks at the mold space defining station, wherein the cope and drag flasks of said one pair are in a horizontal position;

defining upper and lower molding spaces by inserting upper and lower squeezing members into the respective openings of the flasks of said one pair opposed to the respective patterns of the match plate such that the upper molding space is defined by the cope flask, the top face of the match plate, and the upper squeezing member, and the lower molding space is defined by the drag flask, the bottom face of the match plate, and the lower squeezing member, wherein each molding space has an initial volume;

rotating said one pair of the flasks, match plate and squeezing members in a vertical plane from said mold space defining station where said one pair of flasks are in a horizontal position to said sand-supplying station where said one pair of the flasks that hold the match plate therebetween are in a vertical position;

first, injecting molding sand into each molding space that has the initial volume, through the sand-filling ports of each cope and drag flask of said one pair of the flasks while in the vertical position and at the sand-supplying station;

increasing a volume in each molding space over the initial volume by retracting the upper and lower squeezing members by a predetermined length;

second, injecting molding sand into each molding space that has the increased volume from the sand filling ports;

advancing the upper and lower squeezing members, following the second injecting step, to squeeze the molding sand within the upper and lower molding spaces to form upper and lower molds in the flasks;

rotating said one pair of the flasks in which the upper and lower molds have been formed and the squeezing members in the vertical plane from said sand-supplying station back to said mold space defining station where said one pair of flasks are again in a horizontal position;

retracting the squeezing members from the respective openings of the flasks of said one pair of flasks, separating the cope and drag flasks of said one pair of flasks and removing the match plate from between the cope and drag flasks;

rotating said one pair of flasks in which the upper and lower molds have been formed in a horizontal plane from said mold space defining station to a stripping station while simultaneously rotating a second pair of flasks disposed in a parallel relation on a horizontal level from said stripping station to said mold space defining station so that the squeezing members can be inserted in the respective openings of the flasks of said second pair of flasks at the mold space defining station and define upper and lower molding spaces in the second pair of flasks;

stacking the cope and drag flasks of said one pair of flasks at the stripping station so that the upper and lower molds in the flasks are stacked; and stripping the stacked upper and lower molds from the cope and drag flasks of said one pair of flasks at the stripping station.

2. The method of claim 1, wherein said second injection of the molding sand is begun after said step of increasing the volume in each molding space has been completed and thus the desired volume in each molding space has been reached.

3. The method of claim 1, wherein said second injection of the molding sand occurs while the upper and lower squeezing members are being retracted in said step of increasing the volume in each molding space such that said second injection of the molding sand is begun before the desired volume has been reached in said step of increasing the volume in each molding space.

4. The method of any one of claims 1, 2, and 3, wherein the cope and drag flasks of said one pair are in their vertical position during said steps of the first and second injections of the molding sand.

5. The method of claim 4, wherein said step of defining the molding spaces is carried out while the cope and drag flasks of said one pair and the match plate are rotating from the mold space defining station and are in the horizontal position to the sand-supplying station and are in the vertical position.

6. The method of claim 1, wherein each of the upper and lower squeeze members is a squeezing plate or squeezing foot.

7. A method for molding stacked upper and lower molds with a flaskless molding machine that includes:

two pairs of a cope flask and a drag flask, each flask defining an opening and having at least one sand-filling port on a sidewall thereof for injecting molding sand into the opening;

a match plate having upper and lower patterns on top and bottom faces corresponding to the cope and drag flasks of one pair of the two pairs of the flasks; and a mold space defining station, a sand-supplying station and a mold stripping station;

said method comprising the steps of:

clamping and holding the match plate between one pair of the cope and drag flasks at the mold space defining station, wherein the cope and drag flasks of said one pair are in a horizontal position;

defining upper and lower molding spaces by inserting upper and lower squeezing members into the respective openings of the flasks of said one pair opposed to the respective patterns of the match plate such that the upper molding space is defined by the cope flask, the top face of the match plate, and the upper squeezing member, and the lower molding space is defined by the drag flask, the bottom face of the match plate, and the lower squeezing member, wherein each molding space has an initial volume;

rotating said one pair of the flasks, match plate and squeezing members in a vertical plane from said mold space defining station where said one pair of flasks are in a horizontal position to said sand-supplying station where said one pair of the flasks that hold the match plate therebetween are in a vertical position;

first injecting molding sand into each molding space that has the initial volume, through the sand-filling ports of each cope and drag flask of said one pair of the flasks while in the vertical position and at said sand-supplying station;

increasing a volume in each molding space over the initial volume by retracting the upper and lower squeezing members by a predetermined length;

second, injecting molding sand into each molding space that has the increased volume from the sand filling ports;

advancing the upper and lower squeezing members, following the second injecting step, to squeeze the molding sand within the upper and lower molding spaces to form stacked upper and lower molds in said one pair of flasks while rotating said one pair of the flasks and the squeezing members in the vertical plane from said sand-supplying station back to said mold space defining station where said one pair of flasks are again in a horizontal position;

retracting the squeezing members from the respective openings of the flasks of said one pair of flasks, separating the cope and drag flasks of said one pair of flasks and removing the match plate from between the cope and drag flasks;

stacking the cope and drag flasks;

rotating said one pair of stacked flasks in which the upper and lower molds have been formed in a horizontal plane from said mold space defining station to a stripping station while simultaneously rotating a second pair of flasks disposed in a parallel relation on a horizontal level from said stripping station to said mold space defining station so that the squeezing members can be inserted in the respective openings of the flasks of said second pair of flasks at the mold space defining station and define upper and lower molding spaces in the second pair of flasks; and stripping the stacked upper and lower molds from the stacked cope and drag flasks of said one pair of flasks at the stripping station.

8. The method of claim 7, further comprising the step of setting a core in each mold prior to said step of stacking the cope flask and the drag flask of said one pair of flasks.

9. The method of claim 7 or 8, wherein said second injection of the molding sand is begun after said step of increasing the volume in each molding space has been completed and thus the desired volume in each molding space has been reached.

10. The method of claim 7 or 8, wherein said second injection of the molding sand occurs while the upper and lower squeezing members are being retracted in said step of increasing the volume in each molding space such that said second injection of the molding sand is begun before said step of increasing the volume in each molding space has been completed by reaching the desired volume.

11. The method of claim 7 or 8 wherein said step of defining the molding spaces is carried out while the cope and drag flasks of said one pair, and the match plate, are in the horizontal position; and said cope and drag flasks are in the vertical position during said steps of the first and second injections of the molding sand.

12. The method of claim 7 or 8, wherein each of the upper and lower squeeze members is a squeezing plate or squeezing foot.

* * * * *